United States Patent [19]

Finlay

[11] Patent Number: 5,074,576

[45] Date of Patent: Dec. 24, 1991

[54] COMBINATION CONTAINER AND CART

[76] Inventor: Richard O. Finlay, 21851 Newland St., Sp. 254, Huntington Beach, Calif. 92646

[21] Appl. No.: 574,108

[22] Filed: Sep. 24, 1990

[51] Int. Cl.[5] ..... B62B 1/12

[52] U.S. Cl. ..... 280/645; 206/315.6; 206/315.7; 280/47.26; 280/DIG. 6

[58] Field of Search ..... 206/315.3, 315.4, 315.5, 206/315.6, 315.7; 248/96; 280/645, 646, 651, 652, 655, 47.24, 47.26, DIG. 6

[56] References Cited

U.S. PATENT DOCUMENTS

| | | | |
|---|---|---|---|
| 1,409,323 | 3/1922 | Wells | 206/315.5 |
| 1,494,668 | 5/1924 | Critchlow | 206/315.5 |
| 1,726,245 | 8/1929 | Shelton | 206/315.4 |
| 2,760,782 | 8/1956 | Hartzell | 280/DIG. 6 X |
| 2,890,061 | 6/1959 | Watson | 280/47.26 |
| 2,902,287 | 9/1959 | Elias | 280/DIG. 6 X |
| 3,014,732 | 12/1961 | Schenauer | 280/41 |
| 3,025,074 | 3/1962 | Owen | 280/42 |
| 3,425,708 | 2/1969 | Sato | 280/47.19 |
| 3,738,677 | 6/1973 | Rehock | 280/DIG. 6 X |
| 4,245,684 | 1/1981 | Street et al. | 206/315.4 |
| 4,726,597 | 2/1988 | Hickin | 280/DIG. 6 X |
| 4,792,152 | 12/1988 | Carolan | 280/47.26 |
| 4,832,362 | 5/1989 | Chen | 280/47.26 X |
| 4,890,856 | 1/1990 | Mursch et al. | 280/646 |

*Primary Examiner*—Andres Kashnikow

*Assistant Examiner*—Michael Mar

*Attorney, Agent, or Firm*—Plante, Strauss, Vanderburgh & Connors

[57] ABSTRACT

A golf club container and cart combination comprises a frame on which is carried the container element for the golf clubs and ancillary golf equipment. The container, interior, is divided into two coaxial spaces, a center space and an outer circumferential club containing space. The center space may be further divided into two or more compartments. The upper compartments are accessed through the upper end of the container and a wheel container is defined at the lower end of the bag and is accessed through the bottom of the bag.

The frame carries a pivotal handle which may be folded back against the bag of the container or extended when utilizing the device as a pull-cart. A foldable strut assembly is also carried by the frame and is adapted to be folded flat against the frame or extended in a cantilever fashion to carry a wheel and axle assembly. The wheel and axle assembly is removable from the strut assembly and when utilized and assembled on the strut assembly the wheel and axle assembly is in an extended position to provide stability or the cart. When removed from the strut assembly for storage, the wheel and axle assembly can be contracted so that the entire assembly may be stored in the lower wheel compartment of the container.

14 Claims, 7 Drawing Sheets

COMBINATION CONTAINER AND CART

FIELD OF THE INVENTION

The present invention relates to containers and carts and more particularly to a container and cart combination especially suited for golf clubs and golf equipment.

BACKGROUND OF THE INVENTION

Conventionally, golf clubs are carried in a container designed for that purpose which generally comprises a elongated cylindrical body closed at one end and open at the opposite end. The interior of the cylinder defines a club carrying area in which the clubs are normally stored handle down so that the club heads are beyond the open end of the bag. Conventionally pockets are sewn or otherwise attached to the interior surface of the bag for carrying ancillary equipment such as extra golf balls, tees, golf clothing and the like. Golf bags come in a variety of sizes and weights with the more desirable bags composed of leather or similar type of material with relatively large pockets. Needless to say such bags are very heavy and not readily carried by the average golfer if the golfer desire to walk the course for beneficial exercise.

The golf cart was developed to ease the burden of the golfer by providing vehicle which is pulled by a handle and which is adapted to carry the golf bag. Golf carts are normally designed to be collapsed into a more compact form for carrying in an automobile, and the like. These carts are conventionally provided with a pivoting handle which can be folded down against the bag and with wheels which can be folded into a more compact position. However, even in the folded position, conventional golf carts do take a substantial amount of room, particularly in combination with the golf bag, and in addition, the bag and cart combination are cumbersome to lift such as for placement in an automobile trunk or the like. Even more important however, with the advent of newer more compact automobiles, trunk space has been severely limited and it is often impossible to load a golf bag and cart in the space provided within the trunk, even when the cart is in the folded position and impossible to carry more than one bag and cart combination in many compact autos.

Some attempts have been made to bind the golf cart and golf bag into a single unit which presumably would be somewhat lighter and more compact. For example, U.S. Pat. No. 2,890,061 (Watson) discloses a golf club container and cart which is generally a cylindrical container provided with a wheel assembly which can be extended for use and which folds back against the container for storage. The container is provided with a complicated mechanism for holding golf clubs with the club head toward the bottom of the container so that the clubs can be rotated within the cylinder and brought into a position adjacent the cover through which access to the club is achieved. In addition, space is provided within the cylinder to store shoes, golf bags and tees and other equipment. The device can be made compact by removing the wheels, however in that case the wheels are a separate element and require additional storage space.

Another similar golf bag and cart combination is disclosed in U.S. Pat. No. 4,726,597 which discloses a rigid cylindrical element for containing golf clubs and which is provided with a rigid cover and wheels are attached directly to the lower portion of the cylindrical element. This device is primarily adapted to be carried on the back of a recreational vehicle and thus it is formed of suitably weather-resistant material so that it can be stored outside and still provide protection for the golf equipment contained in the cylindrical container. Space requirements, appearance and ease of use are not primary concerns.

U.S. Pat. No. 4,792,152 discloses a golf cart which is adapted to be attached to a conventional golf bag and which is provided with a lower spine on which wheels can be removably attached for storage purposes.

U.S. Pat. No. 3,014,732 (Schenauer) is a combined club container is a U-shaped body provided with dividers for storing the clubs in which the open area of the container receives a portion of the cart wheels when in the folded position. The wheels necessarily extend from the U-shaped body since the wheels must be large enough to provide suitable ground clearance when utilizing the device as a golf cart. Thus a substantial amount of additional space is taken up by the wheels even when in the folded position.

U.S. Pat. No. 3,025,074 (Owen) also discloses a golf container combination in which the wheels can be folded into a more compact position alongside the container. Owen is primarily concerned with a structurally strong device which can serve as a seat for the golfer when the device is tilted into an essentially horizontal position supported by the wheels and the handle.

U.S. Pat. No. 4,245,684 (Street et al.) relates to a golf bag system in which the wheels are retracted into a storage space provided by an extension around the bottom of the container. However, in order to fit in the space the wheels are necessarily small and do not provide sufficient ground clearance to effectively use the device as a golf cart.

U.S. Pat. No. 3,425,708 (Sato) describes yet another golf club container and cart combination. However, Sato is provided with an external container or pocket which extends from the club container thus adding to the space required to store the combination. In addition, the wheels merely fold up against the exterior of the container.

U.S. Pat. No. 1,409,323 (Wells), U.S. Pat. No. 1,494,668 (Critchlow) and U.S. Pat. No. 1,726,245 (Shelton) relate to golf bags or containers for golf clubs which are provided with various storage containers in the center of the bag for the storage of golf bags, tees and the like.

These devices are deficient in that, in most cases, even if the folded position for storage, they are not particularly compact and thus they will not conveniently fit in small trunk space of many automobiles.

SUMMARY OF THE INVENTION

It is, accordingly, an object of the present invention to provide an improved combination container and golf cart for golf equipment.

Another object of the present invention is to provide a combination container and golf cart which can be collapsed in a storage mode which takes up a minimum of storage space.

Still another object of the present invention is to provide a combination container and cart for golf equipment in which the interior of the container is efficiently utilized and which external pockets and the like on the container are eliminated. Another object of the invention is to provide a combination container and golf cart which, when utilized as a golf cart, is well-balanced and easy to pull and is provided with sufficient ground clearance to render the cart convenient to use even on the golf course.

Another object of the invention is to provide a combination container and golf cart which is conveniently adapted for use both on a motorized golf cart and as a pull-cart for carrying the golf clubs which the golfer is walking.

These and other objects and advantages are achieved by the container and cart combination of the present invention which comprises a frame on which is carried the container element for the golf clubs and ancillary golf equipment. The container, interior, is divided into two coaxial spaces, a center space and an outer circumferential club containing space. The center space may be further divided into two or more compartments. The upper compartments are accessed through the upper end of the container and a wheel container is defined at the lower end of the bag and is accessed through the bottom of the bag.

The frame carries a pivotal handle which may be folded back against the bag of the container or extended when utilizing the device as a pull-cart. A foldable strut assembly is also carried by the frame and is adapted to be folded flat against the frame or extended in a cantilever fashion to carry a wheel and axle assembly. The wheel and axle assembly is removable from the strut assembly and when utilized and assembled on the strut assembly the wheel and axle assembly is in an extended position to provide stability or the cart. When removed from the strut assembly for storage, the wheel and axle assembly can be contracted so that the entire assembly may be stored in the lower wheel compartment of the container.

BRIEF DESCRIPTION OF THE DRAWINGS

The features and advantages of the present invention will become even more apparent from the following detailed description and accompanying drawings in which.

DETAILED DESCRIPTION OF THE INVENTION

Figure 1:
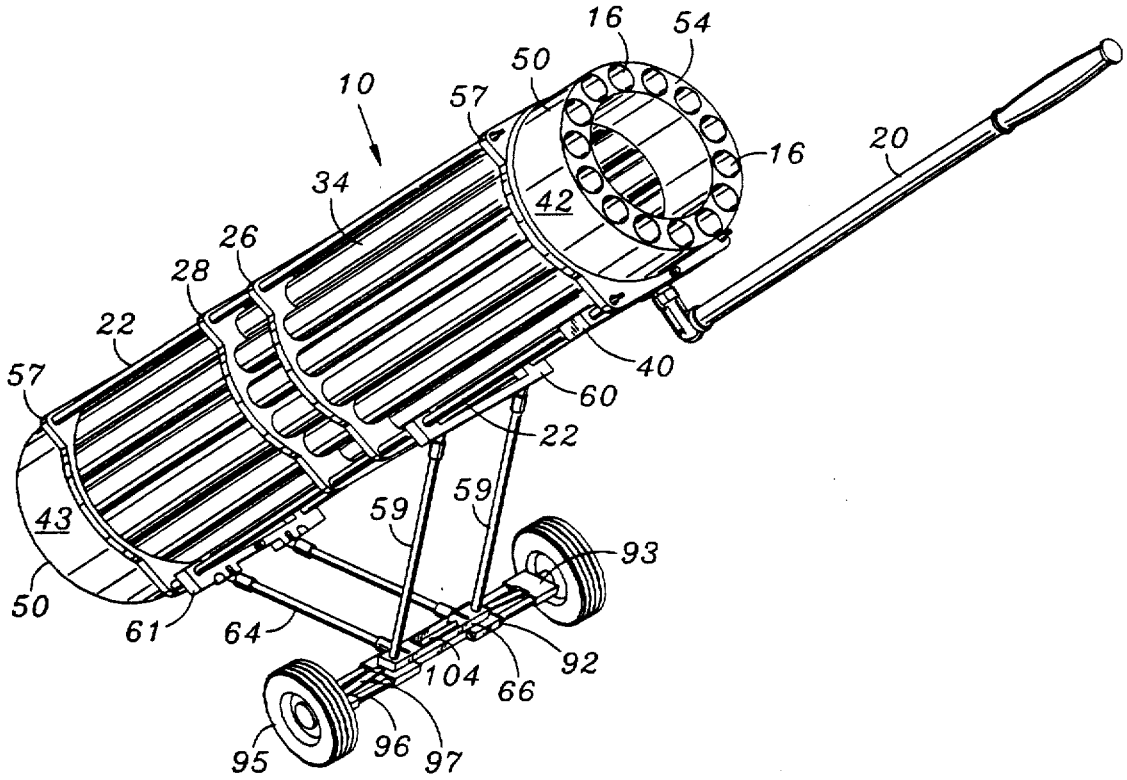
FIG. 1 is a prospective view of the container and cart combination in accordance with the present invention shown with the strut assembly in the extended position with the wheel and axle assembly attached and handle extended for use as a golf cart.

Referring to FIG. 1, there is illustrated generally as 10, a preferred embodiment of the golf cart and container combination of the present invention. The combination 10 comprises a frame member 12 which secures a generally cylindrical container having a plurality of individual compartments 16 for receiving golf clubs (not shown) and a central interior 17 for ancillary golf equipment such as balls, tees and the like. The frame member 12 further carries a wheel strut assembly including legs 59 and braces 64 as adapted, as will be more fully explained, for movement between a folded compact position, and an extended position. A handle 20 is pivotally attached to the frame member 12 for pivoting movement between a folded position and an extended position for pulling or pushing the combination 10 when it is used as a golf cart.

Figure 9:
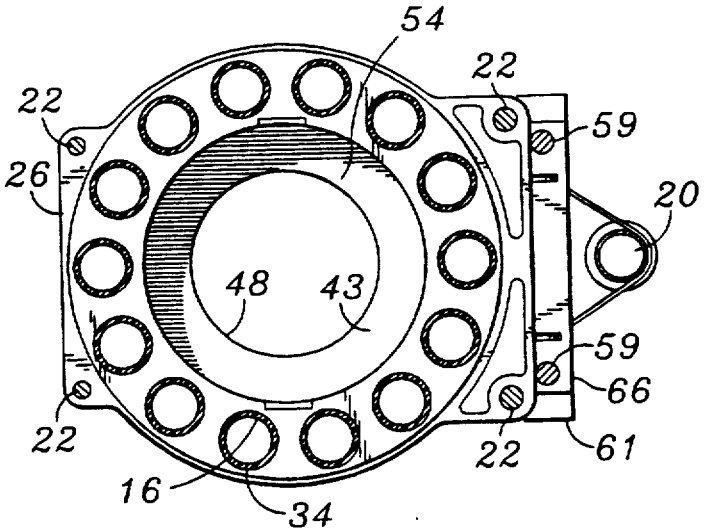
FIG. 9 is a sectional view, along line 9—9 of FIG. 3.
Figure 5:
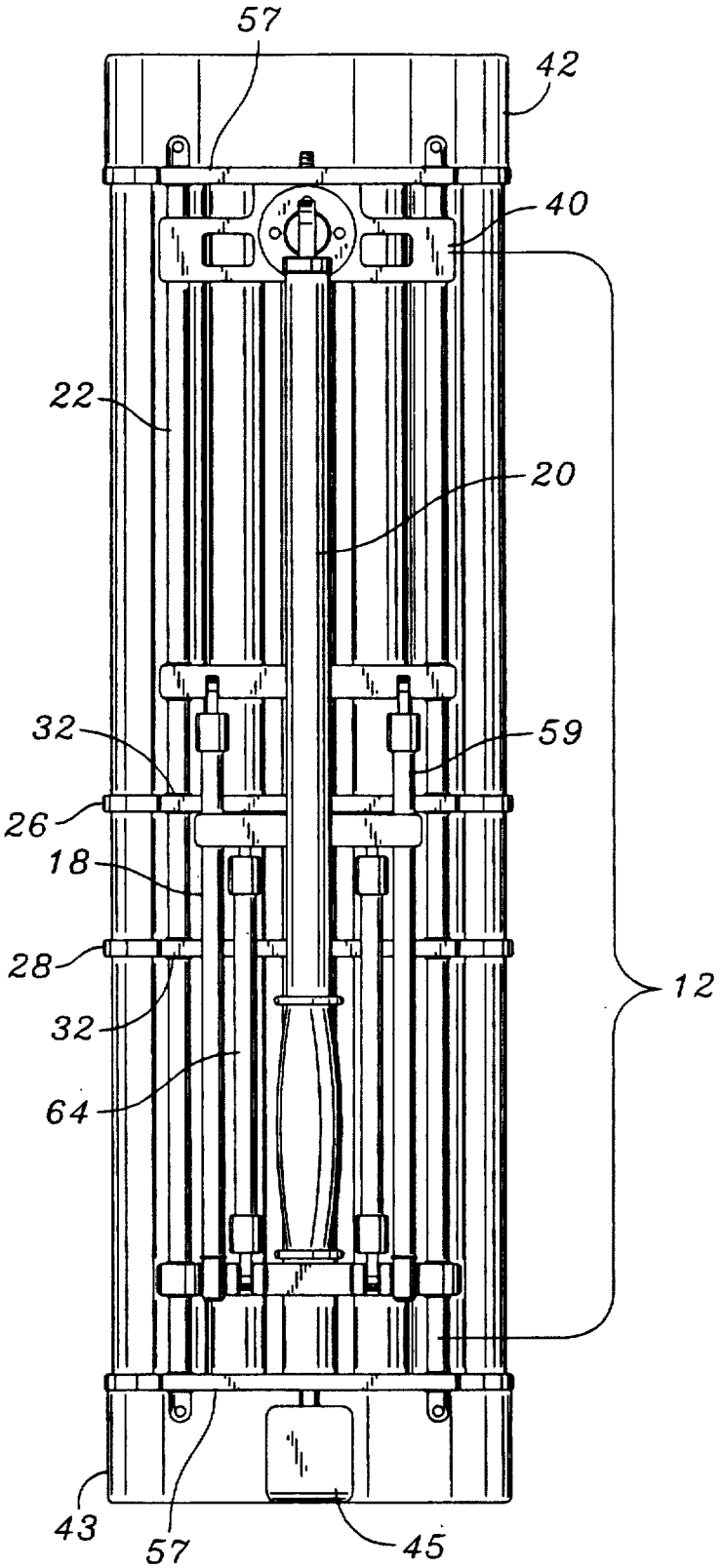
FIG. 5 is a rear elevation of the device as illustrated in FIG. 1.
Figure 6:
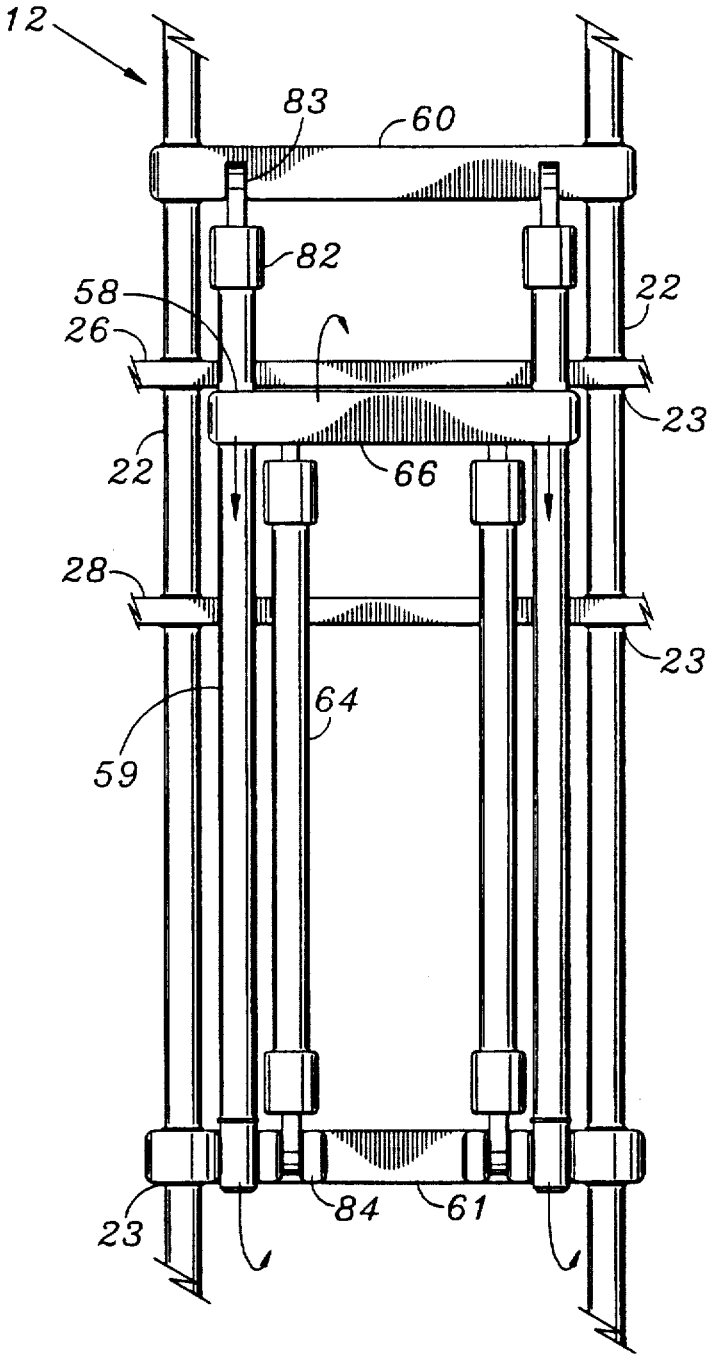
FIG. 6 is an enlarged scale view of a portion of the device of FIG. 1 illustrating the strut assembly in a folded position.

Referring to FIGS. 5, 6 and 9 the frame member 12 comprises plates 26 and 28 and four tierods 22, arranged to define a parallelopiped, which extend through corresponding holes 30 in the plates. The plates 26 and 28 are secured to the tierods 22 by snap rings 23 which are received in spaced apart grooves (not shown) located along each of the tierods 22 at the desired location of the plates 26 and 28. The grooves are spaced apart a distance substantially equivalent to the thickness of the plate 26 and 28 so that when the snap rings are in place the plates are firmly secured along the tierods 22. It will be understood that the frame member 12 can modified to reduce the number of tierods 22, such as for example single pair for carrying the plates 26 and 28 and the wheel strut assembly 18. It will also be apparent that a single tierod 22 can function to carry the plates 26 and 28 and the assembly 18. It is preferred, however, that the frame member 12 contain four tierods 22 as such an arrangement, in combination with the plates 26 and 28, provides a frame 12 that is stable and which can withstand rough treatment. In addition, the two tierods 22 at the backside of the combination 10 opposite the side carrying the handle 20, provide a stable base for supporting the combination 10 when it is laid down.

Figure 3:
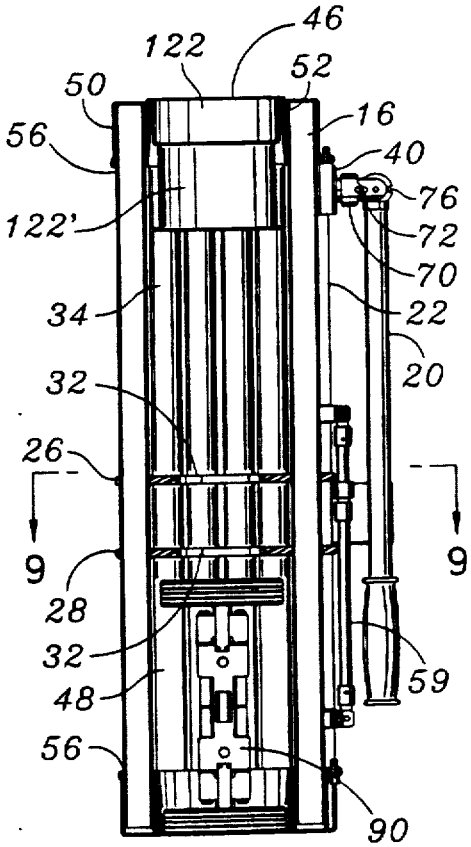
FIG. 3 is a side sectional elevation of the device illustrated in FIG. 1 with the wheel assembly removed and stored and the strut assembly and handle in the folded position.
Figure 4:
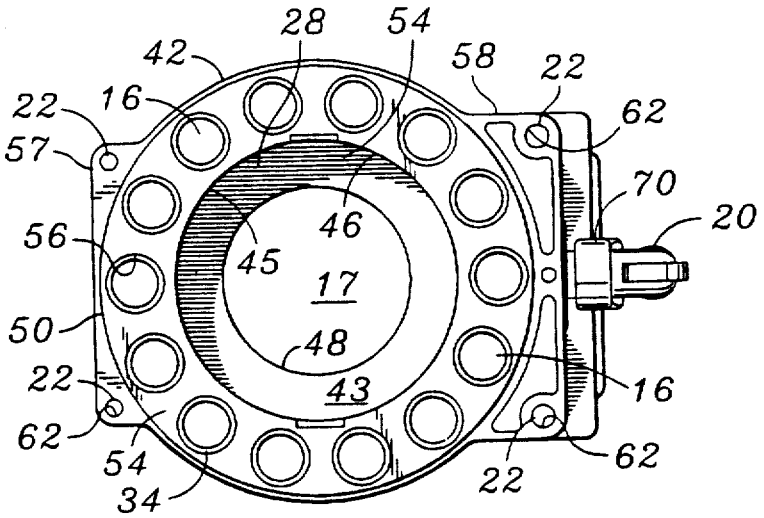
FIG. 4 is a top view of the device illustrated in FIG. 3.

As illustrated most clearly in FIGS. 3 and 9, the plates 26 and 28 are open through their centers with the diameter of the opening in plate 28 being substantially smaller than the center opening in the plate 26. A plurality of apertures 32 are disposed about the periphery of the plates 26 and 28. The apertures 32 are aligned when the plates are fixed on the tierods 22. The container 14 of the combination 10 is defined by a plurality of elongated, open ended tubes 34 which extend through the aligned apertures 32 in the plates 26 and 28 respectively. The bores of the tubes 34 define the individual, coaxial compartments 16 about the periphery of the container 14. The tubes 34 and the compartments 16 defined thereby extend the full length of the container 14 for receiving the grip and shaft portions of individual golf clubs. The radially inwardly facing walls of the peripherally arranged tubes 34 further define in cooperation with the opening of the plate 26, the central compartment 17 which is open at its upper and lower ends. The compartment 17 is divided into an upper section 46 and a lower wheel storage compartment 48 by the plate 28 which, as previously mentioned, has an opening which is substantially smaller than the diameter of the plate 26 and smaller than the diameter of the central compartment 17 so that its upper face serves as the floor of the upper section 46 and its lower face as the top of the wheel storage compartment 48.

Figure 10:
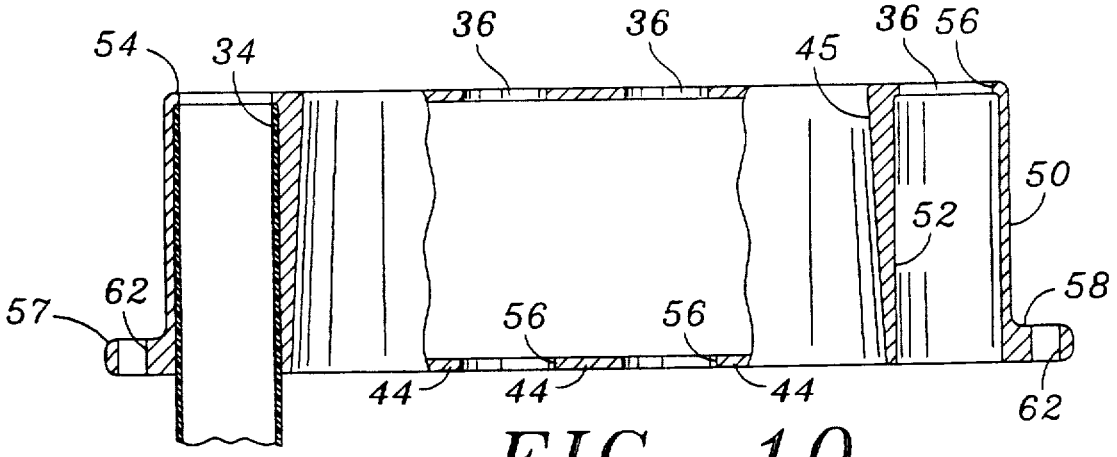
FIG. 10 is a side sectional view of a top cap utilized on the container of the invention.
Figure 11:
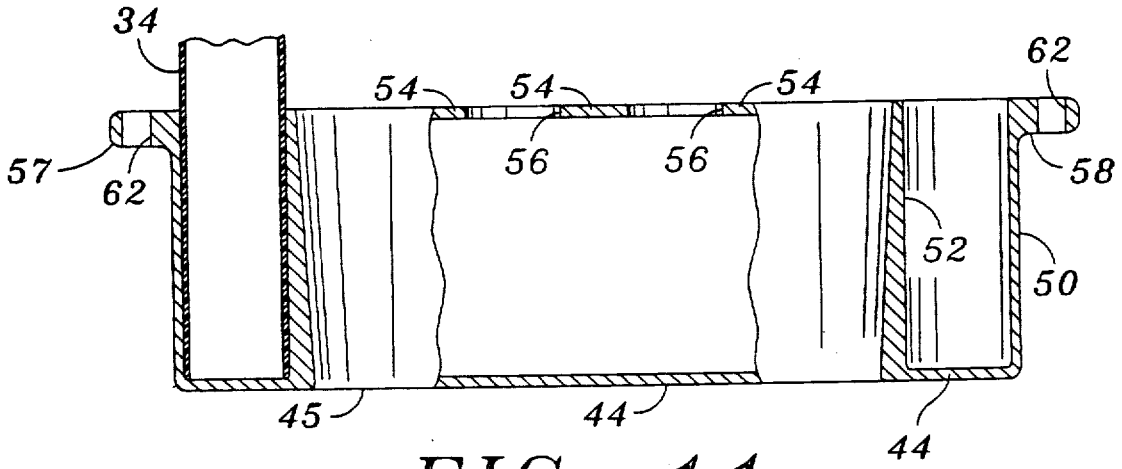
FIG. 11 is a side sectional view of a base cap utilized on the container of the invention.

The top and base of the container 14 are defined by a top cylindrical cap 42 (FIG. 10) and a base cylindrical cap 43 (FIG. 11). The top cylindrical cap 42 comprises an open ended outer cylindrical wall 50 having an annular lower ring 44 and an annular upper ring 54 disposed at each open end thereof. Both of the rings 44 and 54 have center openings 45 which are aligned. A second cylindrical wall 52 extends between the rings and is spaced inwardly of the outer wall 50. Both the upper ring 54 and the lower ring 44 are provided with apertures 56 which correspond in number and alignment with the apertures 32 in the cross plates 26 and 28 and which provide communication through the space defined between the outer cylindrical wall 50 and the second cylindrical wall 52. Mounting webs 57 and 58 are provided on the exterior of the outer cylindrical wall 50 adjacent its lower end and holes 62 are provided therein for the extension therethrough of the upper ends of the tierods 22.

Referring to FIG. 11 where like numbers refer to like parts, the base cylindrical cylindrical cap 43 is similar to the top cal 42 and further includes a lower ring 44 which is free of the apertures 56 for serving as a support for the lower ends of the tubes 34. Both the top cylindrical cap 42 and the base cylindrical cap 43 are secured to the tierods by snap rings 23 in the manner already described above in connection with the plate 26 and 28. The top cylindrical cap 42 and base cylindrical cap 43 serve to secure the ends of the tubes 34 which extend through the corresponding apertures 56 into the space between the walls 50 and 52 of the caps and, as mentioned, the lower ends of the tubes 34 are supported on the upper surface of the lower ring 44 of the base cylindrical cap 43. When affixed to the tierods 22, the top cylindrical cap 42 and the base cylindrical cap 43 cooperate with the frame member 12 to secure the tubes 34 forming the container 14. A toe plate 45 is affixed to base cap 43 at lower surface and bottom to provide abrasion and wear resistance for the base cap 43 at the point of greatest wear when device 10 is utilized as a pull cart.

The interior surface of the inner wall 52 of the top cylindrical cap 42 serves to define the mouth of the upper section 46 of the center compartment of the container 14 while the interior surface of the inner wall 52 of the base cylindrical cap 43 serves to define the mouth of the wheel storage compartment 48. As will be described in more detail hereinafter, the upper section 46 of the center compartment is primarily utilized for the storage of ancillary golf equipment such as golf balls, tees and the like and it may be further divided into sub-compartments in which shoes, sweaters and the like may be segregated from golf balls, golf tees and similar golf equipment. As is evident from the rules of golf the maximum number of clubs which can be carried during a round of golf is fourteen. Consequently the container is preferably constructed using fourteen of the tubes 34 to accommodate the maximum allowable number of clubs. Similarly, the plates 26 and 28 and the cylindrical caps 42 and 43 are provided with a like number of apertures to accommodate the tubes in the manner described.

Figure 2:
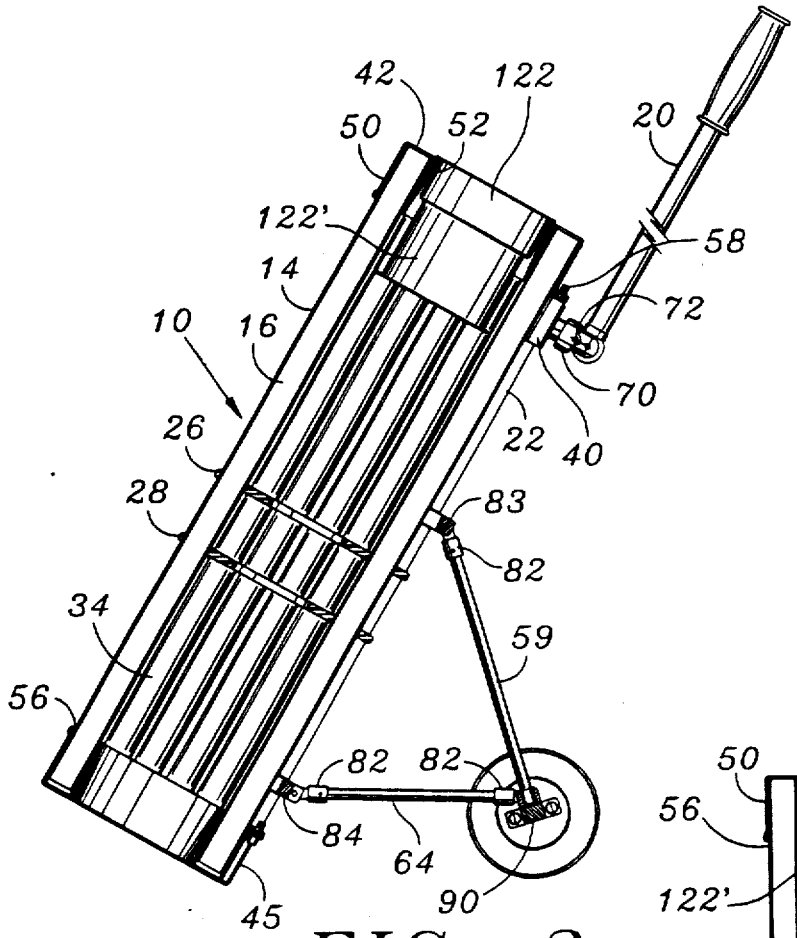
FIG. 2 is a side sectional elevation of the device shown in FIG. 1.

Referring to FIGS. 2, 3 and 5, the handle 20 is pivotally attached at one end to a mounting base 40 carried by the frame 12 for pivotal movement between a folded position against the container 14 as shown in FIG. 3 and an extended position as shown in FIG. 2. The handle 20 is locked in the extended position by a spring-loaded sliding sleeve 70 carrying a stop 72 which is urged by the spring (not shown) into a detent 76 carried by the handle 20 and which is aligned with the stop 72 when the handle 20 is extended. The handle 20 is unlocked to pivot into a folded position by moving the sleeve 70 against the spring a sufficient distance to remove the stop 72 from the detent 76. It will be understood that the handle 20 can also be locked in the extended position by a serrated nut or washer which is clamped with a corresponding serrated nut or washer by locking bolt to retain the handle 20 in the extended position as is common with many conventional pull carts.

The wheel strut assembly consists of a pair of legs 59 and mounting bar 60 having a pair of spaced apart slots which open at one edge of the mounting bar 60 and which are provided with transverse pins (not shown). One end of each of the legs 59 are received in a respective one of the slots 83 and pivotally connected to the mounting bar 60 by a transverse pin which extends through aligned openings in the end of each of the legs 59. The mounting bar 60 is affixed to the tierods 22 at the handle side of the frame member 12 by snap rings 23 in the manner already described above in connection with the cross plates 26 and 28. The legs 59 can be swung between an extended position with the legs 59 cantilevered out from the longitudinal tierods 22 as shown in FIG. 2 and a folded position with the legs 59 folded in against the frame member 12 as shown in FIG. 3. The legs 59 are supported in the extended position by a pair of braces 64, each of which are pivotally attached to brackets 84 on a second, lower mounting bar 61 by a mounting socket 80 consisting of a hollow body 82 which is open at one end to receive the end portion of a brace 64 and which is pivotally connected at its opposite end to the brackets 84 on the mounting bar 61. A strut 66 extends between the legs 59 and is affixed thereto by means of end openings 58 which are spaced apart to correspond with each of the legs 59 for sliding movement of the strut 66 along the leg 59. The opposite end of each of the braces 64 is pivotally connected by means of a mounting socket 80 to the strut 66. In this fashion the braces 64 are unfolded as the legs 59 are extended and serve to limit the outer pivoting of the legs 59 and to maintain the legs 59 in the extended position.

A telescoping wheel assembly 90 is removably attached to the strut 66 when the strut assembly 18 is in the extended position to utilize the container and cart combination 10 in the pull cart mode. The wheel assembly 90 includes a main support 92 and a pair of journal housing 94 into each of which an axle 94 and a wheel 95 are rotatably mounted. Each journal housing 93 carrys a pair of extending arms 96 having ends 98 that are free. The free end 98 of each of the arms 96 is received in a corresponding passage 100 which extends through the support 92 in a direction parallel to the longitudinal axis thereof. When so mounted, the journal housing 94 can be extended for use in the pull-cart mode or telescoped into a compact, retracted position for storage in the wheel storage compartment 48 of the container 14.

Figure 7:
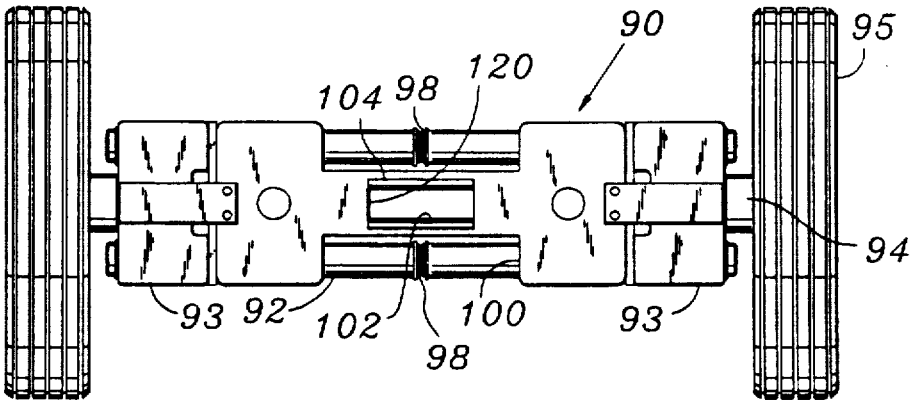
FIG. 7 is an enlarged scale illustration of a portion of the device of FIG. 1 illustrating the strut assembly in an extended position with the wheel axle assembly attached.
Figure 8:
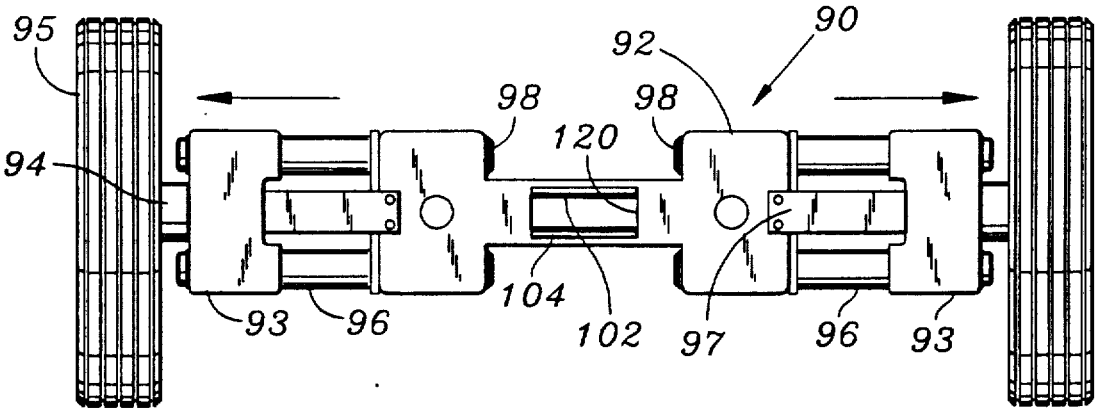
FIG. 8 is an enlarged view showing the wheel axle assembly.
Figure 12:
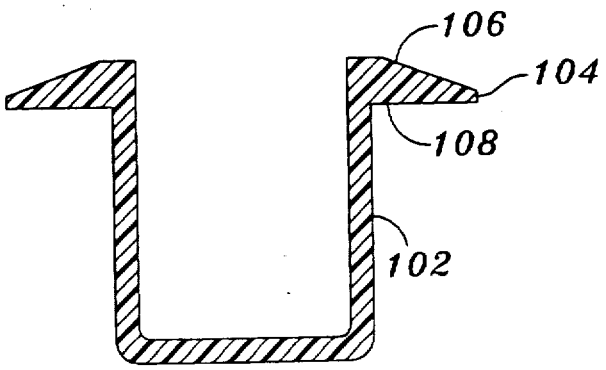
FIG. 12 is an end sectional view of a locking clip for securing the wheel assembly on the strut assembly.

As shown in FIGS. 7, 8 and 12 the wheel assembly 90 is removably attached to the strut 66 of the strut assembly 18. The strut 66 is provided with a locking clip 102 which consists of a resilient U-shaped member, the arms of which have perpendicularly extended edges 104. The upper face of each edge 104 is biased downwardly outwardly to define a camming surface 106 and the lower face defines a locking shoulder 108. The main support 92 is provided with a generally rectangular opening 120 which corresponds in width and length to the dimensions of the U-shaped locking clip 102. The edges of the locking clip 102 are inserted through the opening 120 causing the resilient arms to be urged inwardly by the action of the upper faces of the edges 104 against the edge of the opening 120 and then to snap outwardly to lock the main support 92 to the strut 66. The main support 92 is readily removed from the strut 66 by grasping the edges 104 of the U-shaped locking clip 102 which extend through the opening 120 and urging the resilient arms together to so that the shoulders 108 are freed to permit the main support 92 to be removed from the strut 66. It will be understood, however, that any suitable locking means may be employed to removably attach the main support 92 to the strut 66 and the particular form of locking means is not within the scope of this invention.

Referring to FIG. 3, the device 10 is illustrated in its compact storage mode. The clubs (not shown) are arranged around the periphery of the container 14 in the outer compartments defined by the open-ended tubes. One or more golf equipment receptacles 122 are located in the upper section 46 of the interior of the container 14 for the storage of shoes, golf balls and the like. The handle 20 is pivoted into its folded position and secured in that position. Similarly, the strut assembly 90 is also in its folded position with the braces 64 and legs 59 folded up against the container 14 and with the strut 66 positioned adjacent the upper ends of the legs 59. The strut assembly 90 is retained in its retracted position by the handle 20 which, when folded against the container 14, prevents the strut assembly 90 from moving into its extended position. The wheel assembly 90 is contracted with the journal housings 94 contiguous with the ends of the main support 92 and the wheel assembly 90 is disposed in the wheel storage compartment 48 and retained therein by a strap (not shown) which is secured at one end to the lower portion of the container body 44 and which extends across the opening in the base of the container 14 to a suitable buckle or clip (not shown) which is secured on the opposite side of the container body 44. It will be clear that other means may be employed to secure the wheel assembly 90 in the wheel storage compartment 48 such as, for example, a suitable closure for the opening to the wheel storage compartment 48.

In the storage mode, it is preferred that the club heads be oriented inwardly towards the center of the container 14 so that a protective cover (not shown) can be conveniently placed over the club heads and secured by snap fasteners or the like to the container 14 to protect the club heads.

While in the storage mode it will also be apparent that the container and cart combination 10 can be readily secured upon the club-carrying portion of a motorized golf cart. No alteration or removal of equipment of cart portions of the container and cart combination 10 is required since there are no extending or protruding wheels or other compartments of a conventional golf pull-cart to content with.

To convert the container and cart combination 10 to the golf pull-cart mode, the telescoping wheel assembly 90 is removed from the wheel storage compartment 48 and the handle 20 is released from its folded position and pivoted outwardly away from the container 14 to its extended position and locked in that position. The strut assembly 18 is then free to be moved to its extended position. This is readily accomplished by pivoting the legs 59 in their mounting sockets 62 outwardly from the container 14 which in turns causes the strut 66 to slide downwardly on the legs 59 to pull the braces 64 away from the container 14 into a substantially horizontal position to limit further extension of the legs 59 and to lock them into an extended position. The telescoping wheel assembly 90 is then locked onto the strut 66 by inserting the edges of the clip through the opening 120 in the main support 92 until the locking shoulders are engaged and the wheels are moved into their extended position as illustrated in FIG. 7.

As most clearly shown in FIG. 2, the strut assembly 90 which unfolded and in the extended position places the axles and wheels sufficiently away from the container 14 so that the combination 10 is evenly balanced. By the same token, when in a resting position the lower portion of the container 14 serves as a third point on which to provide a stable three point platform so that the cart is not easily tipped over when at rest. It will also be apparent that the wheels are sufficiently large and spaced far enough away from the container 14 to provide sufficient ground clearance for movement over relatively rough and uneven terrain.

The combination 10 is conveniently returned to the storage mode by first removing the telescoping wheel assembly 90 by forcing the upper edges of the locking clamp 90 together so that the locking shoulders clear the edge of the opening 120 in the main support 92 thus allowing the wheel assembly 90 to be removed from the strut 66. The strut assembly 18 is then moved back to its folded position by an upward sliding movement of the strut 66 which allows the braces 64 to pivot upwardly and the legs 59 to pivot downwardly into the folded position as illustrated in FIG. 3. The wheels and the journal housings 94 of the wheel assembly 90 are positioned against the main support 92 to place the assembly 90 in its contracted mode for being received in the wheel storage compartment 48 of the container 14. The handle 20 is released from its extended position and folded back against the container 14 to make the combination 10 compact and to secure the strut assembly 90 18 in its folded position.

From the foregoing it will be apparent that the container and cart combination 10 of the present invention can be folded into a highly compact unit with the wheels conveniently stored in the container 14 so that the combination 10 takes up a minimum of space and is readily stored or transported, even in automobile having limited trunk space. Moreover, there are no external pockets or pouches to take up additional space while at the same time the interior 16 of the container 14 is efficiently utilized for carrying the maximum number of golf clubs permissible under the rules of golf and ancillary golf equipment as well. It will also be apparent that receptacles 122 can be configured to conform with the dimensions of the center compartment 52 to serve as a cooler so that the golfer may carry cold drinks or sandwiches or the like within the container 14 which is not normally possible with conventional golf bags. Preferably two receptacles 122 are utilized, a first larger receptacle 122 being inserted into the center compartment 52 to carry larger objects or to serve as a cooler, while a second smaller receptacle 122 is located in the upper portion of the center compartment adjacent the open-mouth of the container 14 to receive golf balls, tees, ball markers and the like. The container 14 may be covered by any suitable material such as is currently used for golf bags, such as leather, vinyl or other similar weather-resistant and tough materials. It is preferred, however, to utilize light-weight materials such as nylon in order to keep the weight of the total device to a minimum.

As will be understood by those skilled in the art, various arrangements other than those described in detail in the specification will occur to those persons skilled in the art, which arrangements lie within the spirit and scope of the invention. It is therefore to be understood that the invention is to be limited only by the claims appended hereto.

Having described the invention, I claim:

1. A combination golf container and cart consisting of a frame and a container for golf equipment such as golf clubs, golf balls and tees and the like, said frame comprising at least one longitudinal tierod having an open ended cylindrical cap secured at the top and bottom ends thereof and a plate secured thereto intermediate said top and base cylindrical caps, said caps and said plate each having a central opening and plurality of openings disposed about the periphery thereof, said openings being aligned, tubes disposed in said peripheral openings for receiving golf clubs, said tubes extending between said top and said base cylindrical caps and being arranged about said central opening to define the periphery of said container and a central circular compartment therein, mounting means affixed to said frame, a foldable wheel strut assembly carried by said mounting means, said wheel strut assembly being moveable between a folded compact position and an extended position, a wheel assembly which includes a pair of wheels interconnected by a main support bracket, each of said wheels having a diameter less than the diameter of said central circular compartment, said wheel assembly being removably attached to said strut assembly when said strut assembly is in the extended position and adapted to be inserted through the central opening of said base cap and received within said central compartment when detached from said strut assembly, and a handle which can be extended from said frame.

2. The combination golf container and cart of claim 1 wherein said top cylindrical cap comprises a annular lower ring and an annular upper ring, said rings being carried at each end of an open ended inner cylindrical wall in spaced relationship, each of said annular rings having a center opening and a plurality of peripheral openings disposed about said center opening, said center openings and said peripheral openings of said annular rings being aligned for communication therethrough, an outer cylindrical wall having an outside diameter equal to the outside diameter of said annular rings, and an annular peripheral space defined between said inner and outer cylindrical walls.

3. The combination golf container and cart of claim 1 wherein said tubes define individual peripheral compartments for receiving golf clubs and said central compartment is divided into an upper and a lower central section by said intermediate plate.

4. The combination golf container and cart of claim 3 wherein said inner wall of said top cylindrical cap defines the mouth of the upper section of said center compartment of said container.

5. The combination golf container and cart of claim 1 wherein said base cylindrical cap comprises a annular lower ring and an annular upper ring, said rings being carried at each end of an open ended inner cylindrical wall in spaced relationship, each of said annular rings having a center opening aligned with said center openings of said top cylindrical cap and said intermediate plate, a plurality of peripheral openings disposed about said center opening of said upper annular ring, said peripheral openings in said upper annular ring being corresponding in number to and being aligned with said peripheral openings in said top cylindrical cap and said intermediate plate, an outer cylindrical wall having an outside diameter equal to the outside diameter of said annular rings, an annular peripheral space defined between said inner and outer cylindrical walls and cooperating with said lower annular ring to define a peripheral chamber for receiving and supporting the lower ends of said tubes and the interior surface of said inner cylindrical wall defining an opening for communication with the interior of said lower section of said center compartment.

6. The combination golf container and cart of claim 1 wherein said frame comprises four of said tierods arranged to define a parallelopiped and a second plate in spaced relation to said intermediate plate disposed along said tierods intermediate said top and said base cylindrical caps, said plates and said top and base cylindrical caps being secured on said tierods to form a stable frame for supporting said tubes, said handle and said foldable strut assembly.

7. The combination golf container and cart of claim 1 wherein a mounting base is affixed to said frame and said handle is pivotally attached at one end to said mounting base for pivotal movement between a folded position against said container and an extended position away from said container.

8. The combination golf container and cart of claim 1 wherein a mounting bar is affixed to said frame to carry said foldable wheel strut assembly, said foldable wheel strut assembly comprising a pair of legs each pivotally attached at one end to said mounting bar, a strut extends between each of said legs and is slidingly affixed thereto openings which are spaced apart to correspond with each of said legs and which have a diameter sufficient to permit sliding movement of said strut along said legs, a second, lower mounting bar affixed to said frame, a pair of braces extend between said lower mounting bar and said strut, each said brace being pivotally connected at one end to said mounting bar and pivotally connected at the opposite end to said strut, whereby said legs can be swung between an extended position cantilevered out from said frame with said braces supporting said legs in the extended position and a collapsed position with said legs and said braces folded in against said frame.

9. The combination golf container and cart of claim 1 wherein said main support bracket is dimensioned to extend between said legs of said strut assembly when said legs are extended, a pair of journal housings carried on the outer ends of said main support into each of which an axle carrying a wheel is journaled, said wheel being carried by said axle for rotation with respect to said main support bracket, each said journal housing further including a pair of parallel support rods one end portion of which is carried by said journal housing and the opposite end portion of which extends from said journal housing in a direction opposite said axle, said extending end portion of each of said support rods being slidingly received in a corresponding through-running passage in said support bracket for movement of said each of said journal housings in a direction parallel to the longitudinal axis of said main support bracket whereby each said journal housing can be moved to an extended position away from said main support bracket and a retracted position for storage in said central compartment of said container.

10. The combination golf container and cart of claim 9 wherein said wheel assembly is removably attached to said slidable strut of said foldable strut assembly.

11. The combination golf container and cart of claim 10 wherein said wheel assembly is removably attached to said slidable strut of said foldable strut assembly by means of a locking clip which comprises a resilient U-shaped member, the arms of which have perpendicularly extended edges having an upper surface biased downwardly outwardly from said member to define a camming surface and a lower surface which defines a locking shoulder, said extended edges of said member thereby being adapted to extend through a generally rectangular opening in said slidable strut of said strut assembly which corresponds in width and length to the dimensions of said U-shaped locking clip, whereby said biased upper surfaces of said extended edges act against edge portions of said slidable strut adjacent said opening causing the arms of said resilient member to be urged inwardly as said edges pass through said opening and responsive to the outward urging of said resilient member to lock said main support bracket to said slidable strut when the locking shoulders of said resilient member have cleared said opening.

12. A combination golf container and cart consisting of a frame and a container for golf equipment such as golf clubs, golf balls and tees and the like, said frame comprising four longitudinal rods arranged to define a parallelopiped, an open ended cylindrical cap secured at the top and baseends thereof, said top cylindrical cap comprising an annular lower ring and an annular upper ring, said rings being carried at each end of an open ended inner cylindrical wall in spaced relationship, each of said annular rings having a center opening and a plurality of peripheral openings disposed about said center opening, said center openings and said peripheral openings of said annular rings being aligned for communication therethrough, an outer cylindrical wall having an outside diameter equal to the outside diameter of said annular rings, and an annular peripheral space defined between said inner and outer cylindrical walls, said base cylindrical cap comprising an annular lower ring and an annular upper ring, said rings being carried at each end of an open ended inner cylindrical wall in spaced relationship, each of said annular rings having a center opening aligned with said center openings of said top cylindrical cap and said intermediate plate, a plurality of peripheral openings disposed about said center opening of said upper annular ring, said peripheral openings in said upper annular ring being corresponding in number to and being aligned with said peripheral openings in said top cylindrical cap and said intermediate plate, an outer cylindrical wall having an outside diameter equal to the outside diameter of said annular rings, an annular peripheral space defined between said inner and outer cylindrical walls and the interior surface of said inner cylindrical wall defining an opening through said base cylindrical cap, a plurality of open ended tubes disposed in said peripheral openings of said top and base cylindrical caps, said tubes extending between said top and said base cylindrical caps and being arranged about said central opening thereof to define the periphery of an open ended, generally cylindrical container having a central circular compartment extending therethrough surrounded by a plurality of individual peripheral compartments for receiving the handle and shaft portion of a single golf club, a foldable wheel strut assembly carried by said frame, said foldable wheel strut assembly comprising a mounting bar for attachment to said frame, a pair of legs each pivotally attached at one end to said mounting bar, a strut extending between each of said legs and slidingly affixed thereto by openings in said mounting bar which are spaced apart to correspond with each of said legs and which have a diameter sufficient to permit sliding movement of said strut along said legs, a second, lower mounting bar affixed to said frame, a pair of braces extending between said lower mounting bar and said strut, each said brace being pivotally connected at one end to said mounting bar and pivotally connected at the opposite end to said strut, a wheel assembly removably attached to said foldable strut assembly, said wheel assembly including a main support bracket dimensioned to extend between said legs of said strut assembly, a pair of journal housings carried on the outer ends of said main support into each of which an axle carrying a wheel is journaled, each said wheel having a diameter less than the diameter of said central circular compartment for insertion of said wheel assembly through the central opening of said base cap to be received within said central compartment and each said wheel being carried by said axle for rotation with respect to said main support bracket, each said journal housing further including a pair of parallel support rods one end portion of which is carried by said journal housing and the opposite end portion of which extends from said journal housing in a direction opposite said axle, said extending end portion of each of said support rods being slidingly received in a corresponding through-running passage in said support bracket for movement of said each of said journal housings in a direction parallel to the longitudinal axis of said main support bracket, and a handle which can be extended from said frame.

13. The combination golf container and cart of claim 1 wherein said container comprises a body defining a pair of spaced coaxial tubular members defining a center compartment and an outer club containing space surrounding said center compartment.

14. The combination golf container and cart of claim 13 wherein said center compartment may be further divided into at least an upper and a lower section.

* * * * *

UNITED STATES PATENT AND TRADEMARK OFFICE

CERTIFICATE OF CORRECTION

PATENT NO. : 5,074,576

DATED : December 24, 1991

INVENTOR(S) : Richard O. Finley

It is certified that error appears in the above-identified patent and that said Letters Patent is hereby corrected as shown below:

On the title page, Item [76]:

Correct spelling of Inventor's name to read:

Richard O. Finley

Signed and Sealed this

Sixth Day of April, 1993

*Attest:*

STEPHEN G. KUNIN

*Attesting Officer*

*Acting Commissioner of Patents and Trademarks*